US011628346B2

(12) United States Patent
Taylor

(10) Patent No.: US 11,628,346 B2
(45) Date of Patent: Apr. 18, 2023

(54) ADJUSTABLE HARDNESS PUNCHING BAG

(71) Applicant: Chad Taylor, Chandler, AZ (US)

(72) Inventor: Chad Taylor, Chandler, AZ (US)

( * ) Notice: Subject to any disclaimer, the term of this patent is extended or adjusted under 35 U.S.C. 154(b) by 360 days.

(21) Appl. No.: 17/019,304

(22) Filed: Sep. 13, 2020

(65) Prior Publication Data

US 2022/0080278 A1 Mar. 17, 2022

(51) Int. Cl.
*A63B 69/20* (2006.01)

(52) U.S. Cl.
CPC ..... *A63B 69/305* (2022.08); *A63B 2209/10* (2013.01)

(58) Field of Classification Search
CPC ..... A63B 69/201; A63B 2209/10; A63B 69/20–325; A63B 69/224
See application file for complete search history.

(56) References Cited

U.S. PATENT DOCUMENTS 5,110,124 A * 5/1992 Micco ..... A63B 69/34 73/379.04
5,281,191 A * 1/1994 DeSousa ..... A63B 69/305 473/442
6,063,011 A * 5/2000 Pelchat ..... A63B 69/004 482/90
6,080,089 A * 6/2000 Nicholson ..... A63B 69/224 482/90
6,217,489 B1 * 4/2001 Nicholson ..... A63B 69/305 482/90
6,234,940 B1 * 5/2001 Fotsis ..... A63B 69/305 482/89
6,302,831 B1 * 10/2001 Henry ..... A63B 69/305 482/90
6,398,697 B1 * 6/2002 Nichols, Jr. ..... A63B 69/20 473/441
8,894,552 B2 * 11/2014 Wilson ..... A63B 69/20 482/83
9,021,857 B1 * 5/2015 Squire ..... A63B 71/0622 73/12.04
D740,903 S * 10/2015 Siciliano ..... D21/798
10,076,697 B1 * 9/2018 Publicover ..... A63B 5/11
10,974,119 B1 * 4/2021 Julian ..... A63B 69/305
2011/0237404 A1 * 9/2011 Smith ..... A63B 69/305 482/83
2013/0072358 A1 * 3/2013 Martinez ..... A63B 69/34 482/86
2014/0080681 A1 * 3/2014 Knight ..... A63B 69/34 482/83
2015/0011366 A1 * 1/2015 Hockridge ..... A63B 69/205 29/428
2015/0126339 A1 * 5/2015 Thomas ..... A63B 69/305 482/83

(Continued)

*Primary Examiner* — Nyca T Nguyen
(74) *Attorney, Agent, or Firm* — Morgan Law Offices, PLC

(57) ABSTRACT

A variable hardness punching bag is disclosed herein. The punching bag comprises a core having a first hardness profile; and at least one auxiliary shell attachable to the core, wherein the at least one auxiliary shell has a second hardness profile different to the first hardness profile. The auxiliary shells include a punching shell and a kicking shell, wherein the punching shell is denser and harder relative to the kicking shell. The punching and kicking shells include attachment straps for facilitating attachment to the core.

5 Claims, 5 Drawing Sheets

(56) References Cited

U.S. PATENT DOCUMENTS

| | | | | |
|---|---|---|---|---|
| 2017/0001091 | A1* | 1/2017 | Holmes | A63B 69/26 |
| 2017/0021255 | A1* | 1/2017 | Knight | A63B 69/34 |
| 2017/0021258 | A1* | 1/2017 | Hoggatt | A63B 69/305 |
| 2017/0203178 | A1* | 7/2017 | Gray | A63B 69/34 |
| 2018/0001176 | A1* | 1/2018 | Siklosi | F16B 2/08 |
| 2019/0282880 | A1* | 9/2019 | Bortolotto | A63B 69/305 |
| 2020/0078652 | A1* | 3/2020 | Scott | A63B 69/206 |

* cited by examiner

ADJUSTABLE HARDNESS PUNCHING BAG

TECHNICAL FIELD

The present disclosure relates generally to a punching bag, and more particularly, to a punching bag that allows a user to easily and conveniently vary the hardness of the punching bag as per the requirements of a desired workout routine.

BACKGROUND

A punching bag is a workout equipment used by gym enthusiasts, martial arts practitioners, and the like for several different workout routines. A typical punching bag includes a bag in which a filler material such as sand or stones or cloth are stuffed. Adding the filler material to the bag provides the bag with a certain hardness and weight, which is required to practice punching, kicking, and other similar routines on the bag. Typically, for punching, the punching bag is required to be harder relative to the hardness required for kicking routines. To this end, a user has to vary the amount of the filler material inside the punching bag. The process of varying or changing the quantity of the filler material inside the punching bag is time consuming, laborious, and messy.

There is, therefore, felt a need of a punching bag that allows a user to easily and conveniently vary the hardness profile of the punching bag as per the requirements of a desired workout routine.

SUMMARY

A variable hardness punching bag is disclosed herein. The punching bag comprises a core having a first hardness profile, and at least one auxiliary shell attachable to the core, wherein the at least one auxiliary shell has a second hardness profile different to the first hardness profile. In one embodiment, the first hardness profile of the core is substantially harder and denser to the second hardness profile of the at least one auxiliary shell.

In another embodiment, the auxiliary shells include a punching shell and a kicking shell. In one example, the punching shell is configured to be harder and denser relative to the kicking shell.

In yet another embodiment, the auxiliary shells include an attachment strap configured thereon for facilitating the easy and convenient attachment of the auxiliary shells to the core.

DETAILED DESCRIPTION OF EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

Figure 1:
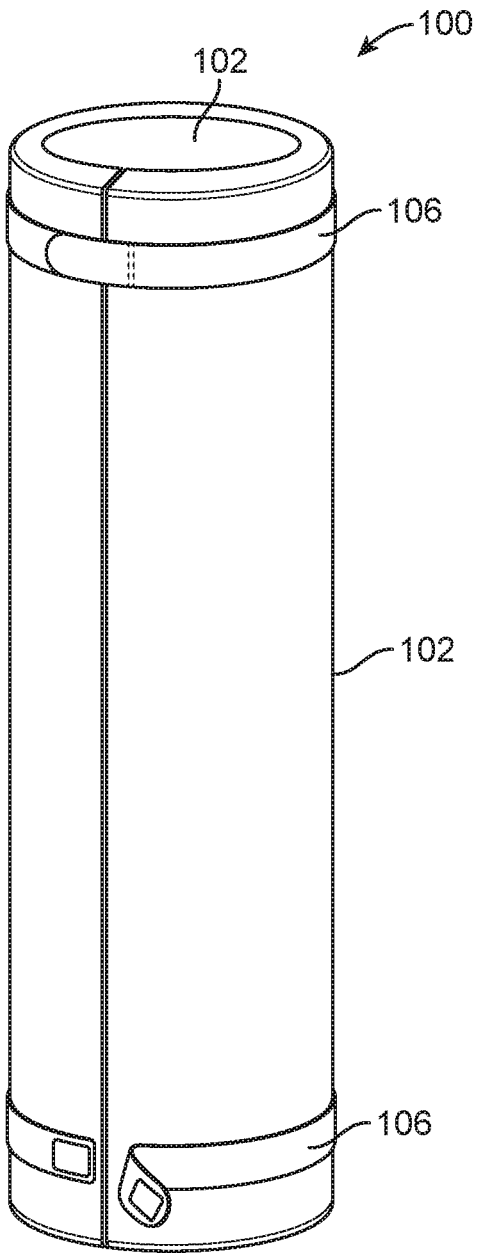
FIG. 1 shows a perspective view of a punching bag, according to a first embodiment of the present disclosure.

Referring to FIG. 1, a perspective view of a punching bag 100, according to a first embodiment of the present disclosure, is illustrated. The punching bag 100 comprises a core 102 and an auxiliary shell 104 attached onto the core 102. In accordance with an embodiment of the present disclosure, the core 102 has a first hardness profile, which is substantially dense and hard. It is required that the core 102 be dense and hard for providing the punching bag 100 with the required weight and toughness to withstand a continuous barrage of punches and kicks. In one embodiment, the weight of the punching bag 100 ranges from 50 pounds to 250 pounds. The auxiliary shell 104 has a second hardness profile such that the first hardness profile of the core 102 is substantially denser and harder relative to the second hardness profile of the auxiliary shell 104.

It is to be noted that the punching bag 100 includes more than one auxiliary shell 104. More specifically, the number of auxiliary shells 104 is equal to the number of different hardness profiles that the punching bag 100 is required to exhibit for different workout regimens. In accordance with one embodiment of the present disclosure, the auxiliary shells 104 include a punching shell and a kicking shell. In accordance with one embodiment, the punching shell is harder and denser relative to the kicking shell.

An auxiliary shell 104 or the punching shell and the kicking shell, in accordance with one embodiment of the present disclosure, are foldable panels having attachment straps 106 that can be used to facilitate attachment of the auxiliary shell 104 or the punching shell and the kicking shell to the core 102 of the punching bag 100.

Figure 2:
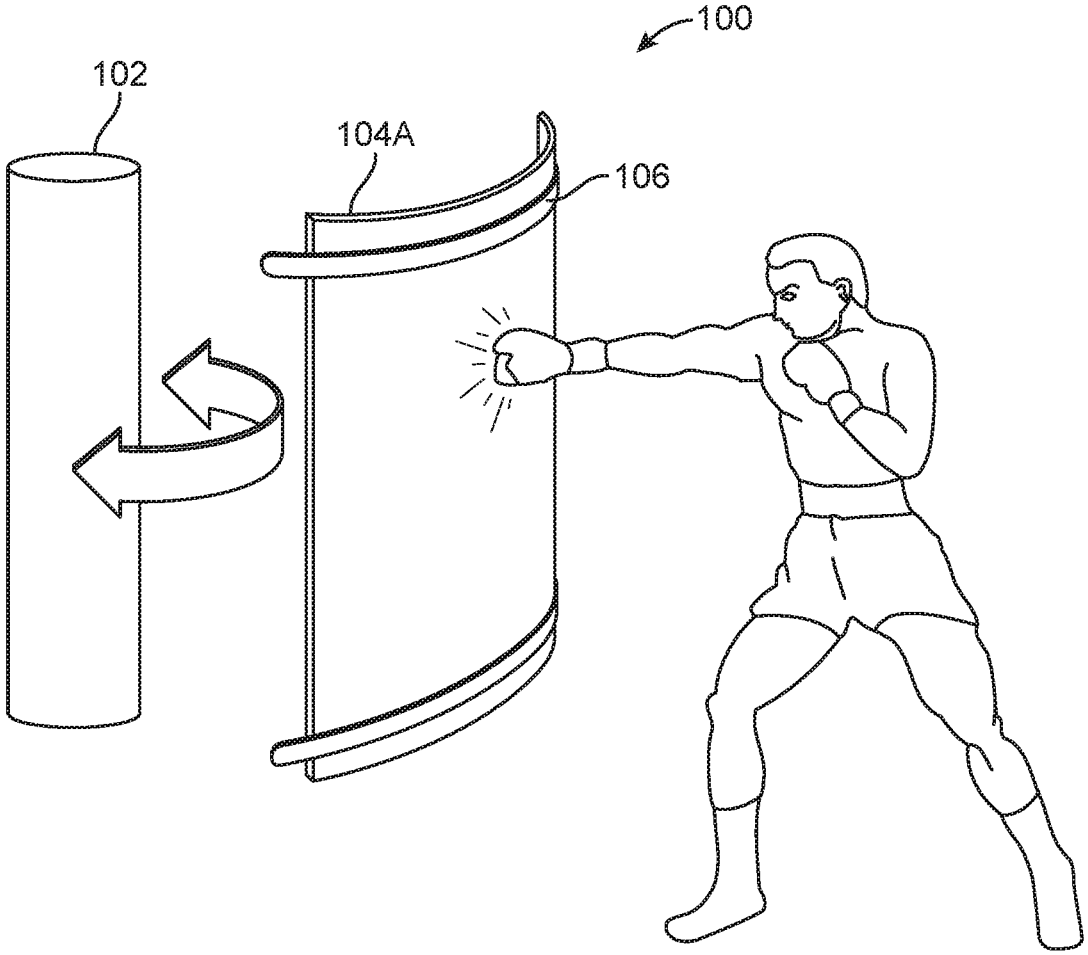
FIG. 2 shows a perspective view of the punching bag depicting the punching shell, according to the first embodiment of the disclosure.

Referring to FIG. 2, a perspective view of the punching bag 100 depicting a punching shell 104A, according to the first embodiment of the disclosure, is illustrated. As seen in FIG. 2, the auxiliary shell, which is the punching shell 104A, may be easily attached onto the core 102 or detached from the core 102 by using the attachment straps 106. In accordance with one embodiment, the attachment straps 106 may be hook and loop straps. In accordance with another embodiment, the attachment straps 106 may be one of snap fit straps, belt buckle straps, and the like.

As seen in FIG. 2, in one embodiment the core 102 has a cylindrical configuration. However, it is to be noted that the shape of the core 102 is not limited to being cylindrical, and the core 102 may be designed to have any other shape to suit custom workout regimen requirements for different kinds of users. For example, the core 102 may have a square cross section, which may be more suited for practicing frontal body blows. In accordance with one embodiment, the core 102 that has the first hardness profile may be made of a rigid foam material such as rigid polyurethane foam and rigid polyethylene foam. Other suitable foam materials may also be used to manufacture the core 102. In another embodiment, the auxiliary shells (the punching shell and the kicking shell) may be made of soft memory foam or viscoelastic materials such as viscoelastic polyurethane foam.

Figure 3:
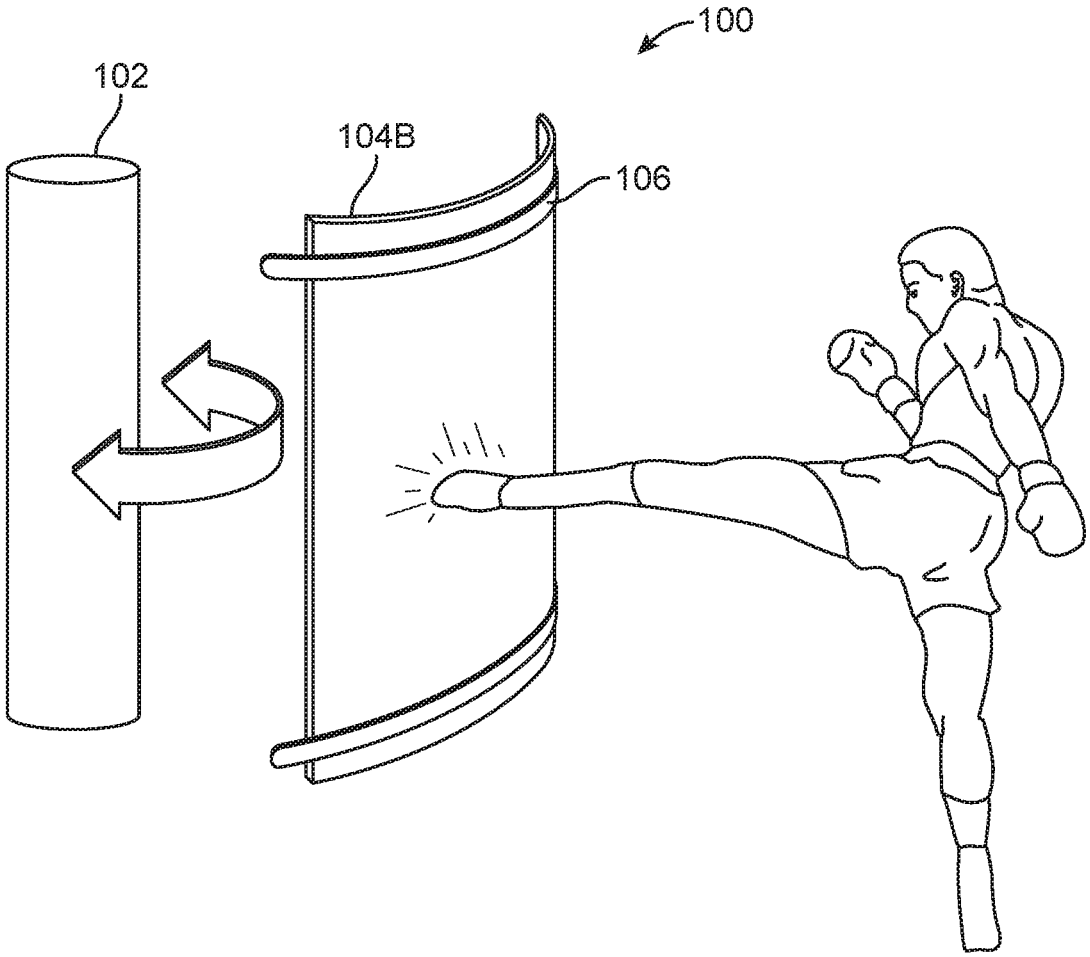
FIG. 3 shows a perspective view of the punching bag depicting the kicking shell, according to the first embodiment of the disclosure.

Referring to FIG. 3, a perspective view of the punching bag 100 depicting a kicking shell 104B, according to the first embodiment of the disclosure, is illustrated. As seen in FIG.

3, the auxiliary shell, which is the kicking shell 104B, may be easily attached onto the core 102 or detached from the core 102 by using the attachment straps 106. In accordance with one embodiment, the attachment straps 106 may be hook and loop straps. In accordance with another embodiment, the attachment straps 106 may be one of snap fit straps, belt buckle straps, and the like.

Figure 4:
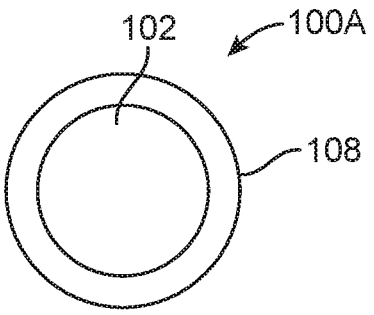
FIG. 4, FIG. 5, and FIG. 6 show different views of the punching bag having a freestanding configuration, according to a second embodiment of the disclosure.
Figure 5:
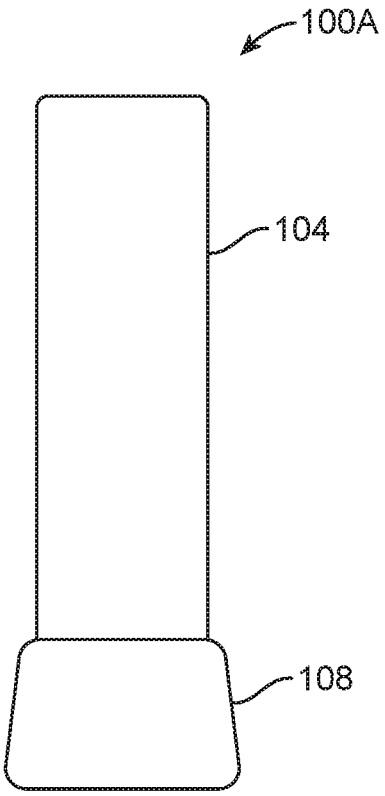
Figure 6:
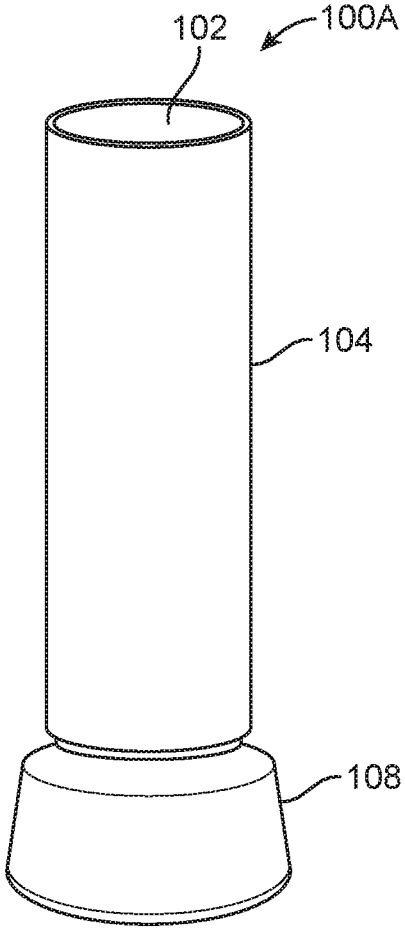

Referring to FIG. 4, FIG. 5, and FIG. 6, different views of the punching bag 100A having a freestanding configuration, according to a second embodiment of the disclosure, are illustrated. This embodiment of the punching bag 100A is similar to the punching bag 100 described above with reference to FIG. 1 thru FIG. 3 with the only difference being that the punching bag 100A has a base 108 for providing the punching bag 100A a free-standing configuration. The base 108 may be a hollow container that may be filled with a suitable filler material such as sand, in accordance with one embodiment.

The core 102 may extend from the base 108. In one embodiment, the core 102 may be inserted within a cavity formed on the base 108. In another embodiment, the punching bag 100A may include a central pole (not shown in figures) of a metallic material extending from the cavity on which the core 102 may be configured. The auxiliary shells may then be attached onto the core 102 that is configured on the central pole. The central pole may be provided to the freestanding punching bag 100A for providing stability to the punching bag 100A for withstanding a continuous barrage of punches and kicks.

Figure 7:
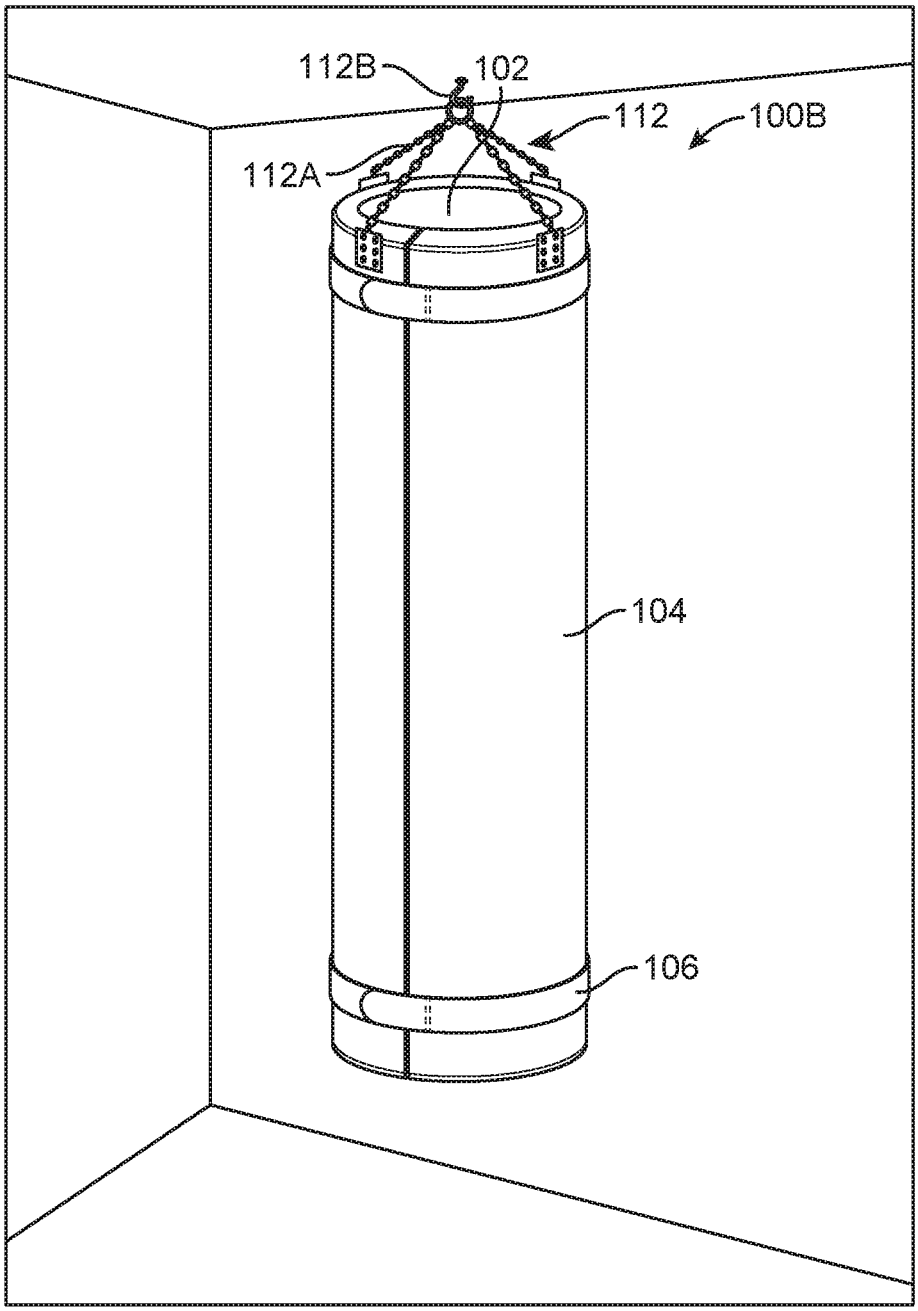
FIG. 7 shows a perspective view of a punching bag in its hanging configuration, according to a third embodiment of the disclosure.

Referring to FIG. 7, a perspective view of a punching bag 100B in its hanging configuration, according to a third embodiment of the disclosure, is illustrated. This embodiment of the punching bag 100B is similar to the punching bag 100 described above with reference to FIG. 1 thru FIG. 3 with the only difference being that the punching bag 100B has a hanging unit 112 for providing the punching bag 100B a hanging configuration. The hanging unit 112 may be attached to the core 102 or the auxiliary shell 104 for facilitating the hanging of the punching bag 100B. In one embodiment, the hanging unit 112 may include one or more chains or straps 112A that can facilitate mounting of the punching bag 100B to a hook 112B configured at a hanging surface, such as a ceiling of a room. In one embodiment, the auxiliary shell 104, instead of being a foldable panel, is a cover having a cylindrical configuration that can house the core 102 therewithin while also having the hanging unit 112 configured on an operative top end thereof.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A variable hardness punching bag comprising:

a core having a first hardness profile; and auxiliary shells attachable to the core, wherein the auxiliary shells have a second hardness profile different to the first hardness profile;

wherein a weight of the punching bag ranges from 50 pounds to 250 pounds;

the core with the first hardness profile is substantially harder and denser than the auxiliary shells with the second hardness profile;

the auxiliary shells include a punching shell and a kicking shell;

the punching shell is substantially denser and harder relative to the kicking shell;

the punching shell and the kicking shell are made of viscoelastic foam; and the punching shell and the kicking shell include at least one attachment strap for facilitating attachment of the punching shell and the kicking shell on the core.

2. The punching bag according to claim 1, wherein the core has a cylindrical configuration.

3. The punching bag according to claim 2, wherein the core is made of one of rigid polyurethane foam or rigid polyethylene foam.

4. The punching bag according to claim 1, wherein the punching bag is a freestanding punching bag comprising a base from which the core extends.

5. The punching bag according to claim 1, wherein the punching bag is a hanging punching bag comprising a hanging unit configured on the core or the at least one auxiliary shell for facilitating hanging of the punching bag.

* * * * *